US005517741A

United States Patent [19]

Reynolds et al.

[11] Patent Number: 5,517,741

[45] Date of Patent: May 21, 1996

[54] METHOD OF OPTIMIZING ASSEMBLY OF STAMPED PARTS

[75] Inventors: Thomas Reynolds, Troy; Robert A. Florian, Farmington Hills; Terrance W. Gillay, Bloomfield Township; John L. Myers, Romeo, all of Mich.

[73] Assignee: Chrysler Corporation, Auburn Hills, Mich.

[21] Appl. No.: 416,109

[22] Filed: Apr. 3, 1995

Related U.S. Application Data

[63] Continuation-in-part of Ser. No. 364,878, Dec. 27, 1994.

[51] Int. Cl.[6] ..... B23Q 17/00

[52] U.S. Cl. ..... 29/407.1; 29/464; 29/557; 29/DIG. 37

[58] Field of Search ..... 29/897.2, 407, 29/464, 557, DIG. 37, DIG. 38

[56] References Cited

U.S. PATENT DOCUMENTS 5,040,161 8/1991 Jones et al. ..... 29/464

5,327,647 7/1994 Gurniak ..... 29/407

FOREIGN PATENT DOCUMENTS 150126 6/1988 Japan ..... 29/DIG. 38

198932 8/1991 Japan ..... 29/897.2

1202926 8/1970 United Kingdom ..... 29/464

*Primary Examiner*—David P. Bryant

*Attorney, Agent, or Firm*—Edward A. Craig

[57] ABSTRACT

A method of optimizing the assembly in abutting relationship of at least two stamped mating sheet metal parts is provided. The method includes the steps of providing bench mark indicia on each of the mating parts at a predetermined location near to the juncture of abutment of the mating parts and then subsequently, after assembly of the mating parts, comparing the relationship of the bench mark indicia of one mating part to the bench mark indicia of another mating part with a predetermined optional relationship.

4 Claims, 4 Drawing Sheets

FIG. 7
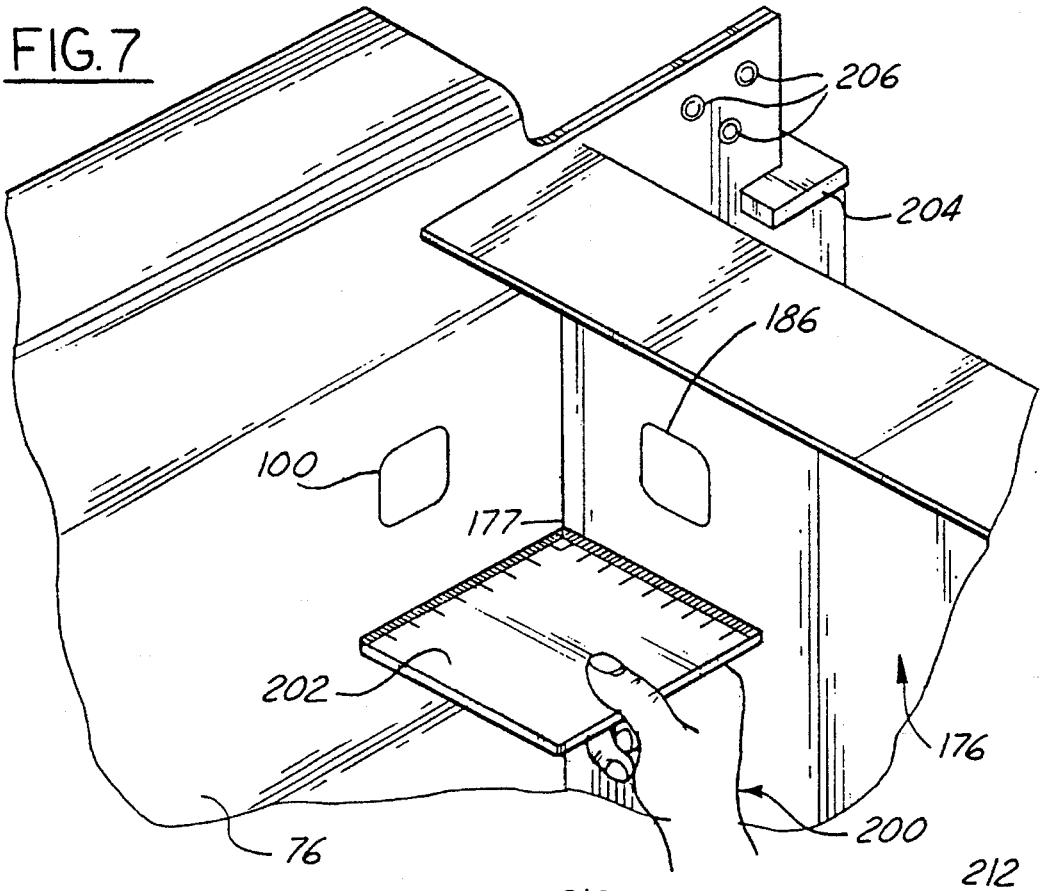
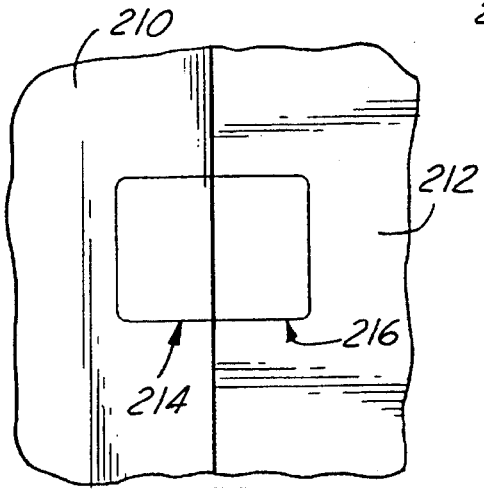
FIG. 8
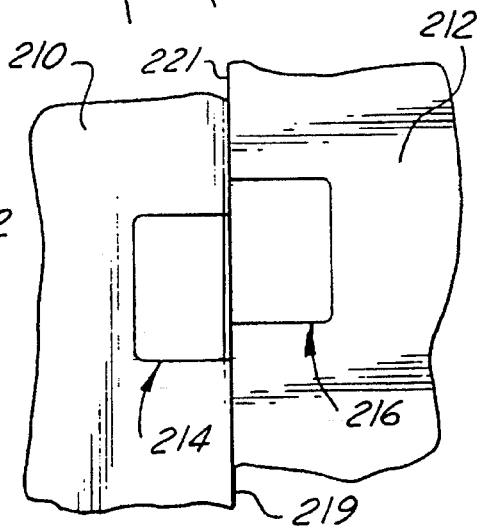
FIG. 9

METHOD OF OPTIMIZING ASSEMBLY OF STAMPED PARTS

CROSS-REFERENCE TO RELATED APPLICATION

This application is a continuation-in-part of application Ser. No. 08/364,878, filed Dec. 27, 1994.

TECHNICAL FIELD

This invention relates to the stamping of bench mark indicia on separate mating stamped sheet metal parts and the subsequent assembly of the mating parts together with the relationship of the bench mark indicia on the mating parts providing a visual check on the dimensional quality of the assembly process.

BACKGROUND OF THE INVENTION

In modern manufacturing processes, quality of the final product has become of increasing concern. The buying public, whether it be industrial buyers or ultimate consumers, has become very quality aware and will reject products which do not meet the exacting standards maintained by the ever more sophisticated buying public. This is particularly true in the automotive field.

Automotive products make extensive use of sheet metal stampings. Such stampings form the exterior body of the vehicle as well as numerous body panels provided behind the exterior surface. Purchasers of vehicles, whether the vehicles are automobiles or light trucks, are highly critical of the total assembly. "Fit and finish" are major concerns and strongly affect the public's decision relative to the purchase of a car or light truck. In addition to perceived quality, structural quality is also very necessary in order to ensure that the vehicle performs and is durable in accordance with the desired standards. This applies to sheet metal parts which may not be seen by the public but which, if not properly made and assembled, will ultimately effect the overall quality of a vehicle and form a basis for customer's making decisions whether or not to repeat a purchase from a particular automotive company.

Stamped sheet metal parts may be improved in the basic manufacturing process in order to result in increased quality. Improved stampings have been obtained with parts made by multiple stamping dies wherein cumulative bench mark indicia are impressed on the parts. A multiple station stamping press line is provided with die sets having special bottoming markers which imprint bench mark indicia on the part at each stamping station to provide a readout on the finally stamped part that reveals the accuracy of stamping at each station and identifies any stations that is not stamping to specifications.

While repeatable stampings of high quality have been provided using the above-identified method, component assemblies of mating stamped parts even when properly made often do not properly match with one another in the assembly to meet standards needed for the desired quality production. To achieve such goals, the present invention provides for the marking of mating stamped parts with bench mark indicia that interrelate with one another. With the parts having bench marking that relate to one another, the parts can, by using the bench marks, be positioned relative to each other and the dimensional quality can be verified by visually examining the relative positions of the bench marks.

It is a feature, object and advantage of this invention to provide new and improved press line stamping procedures and assembly techniques. Preferably, each stamping is formed by a die set having bottoming markers that apply bench marks to the parts being stamped that relate to other parts being stamped so that parts can be matched to one another by the bench marks thus optimizing quality of an assembly of the parts.

These and other features, objects and advantages of this invention will become more apparent from the drawings and the following written matter:

BRIEF DESCRIPTION OF THE DRAWINGS

FIG. 7 is a pictorial view of stamped mating parts having bench mark indicia thereon clamped together for permanent securement; and FIGS. 8 and 9 are diagrammatic views showing other separately stamped mating parts with bench mark indicia thereon made in accordance with the present invention

DETAILED DESCRIPTION OF THE DRAWINGS

Figure 1:
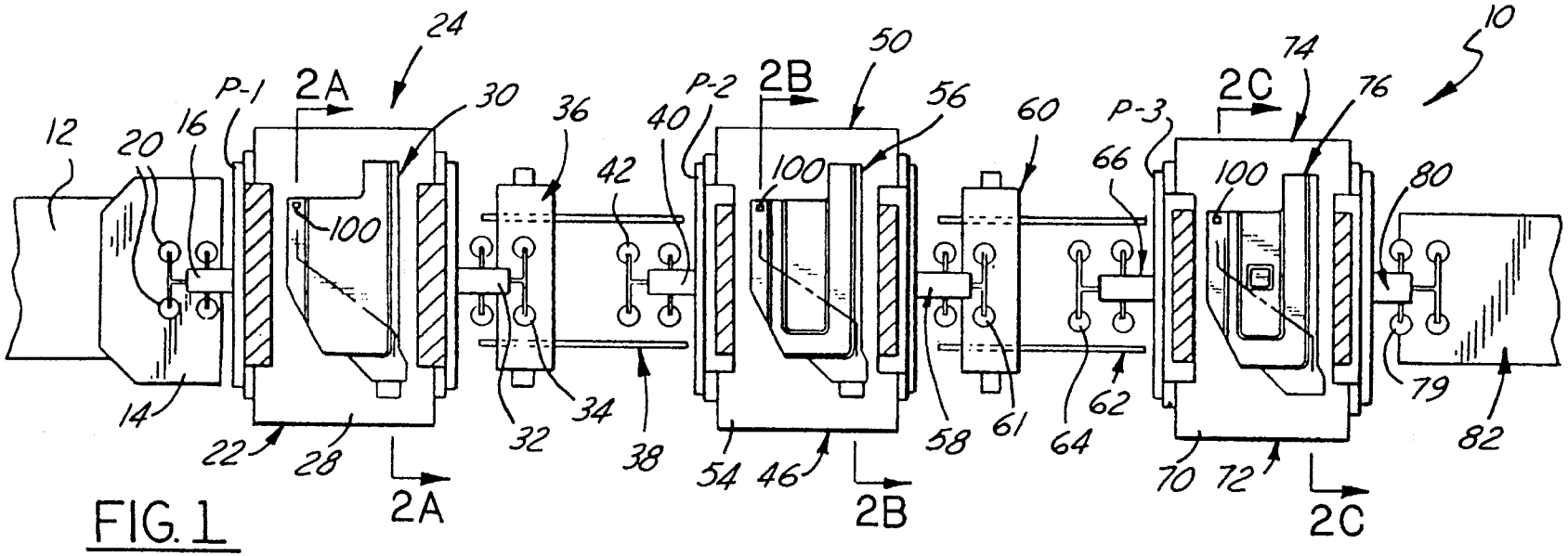
FIG. 1 is a diagrammatic top view of a first stamping press line having multiple stamping stations with the upper dies removed for the purpose of clarity.

Turning now to greater detail to the drawings, there is diagrammatically shown in FIG. 1 a multi-station stamping press line 10 including a loading station 12 supporting a supply of sheet metal blanks 14 which can be serially moved by a retractable loader 16 with suction cups 20 into a first stamping die set 22 of a first stamping station 24 of the press line 10.

Figure 2C:
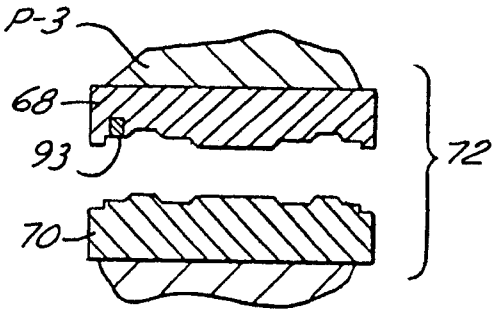
FIGS. 2A, 2B and 2C, respectively, are diagrammatic cross-sectional views of stamping dies to be used with the press line of FIG. 1 and taken along section lines 2A—2A, 2B—2B and 2C—2C of FIG. 1.
Figure 2B:
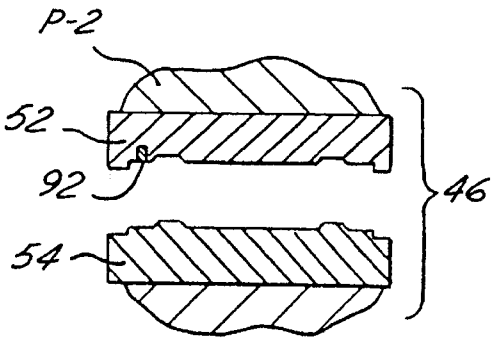
Figure 2A:
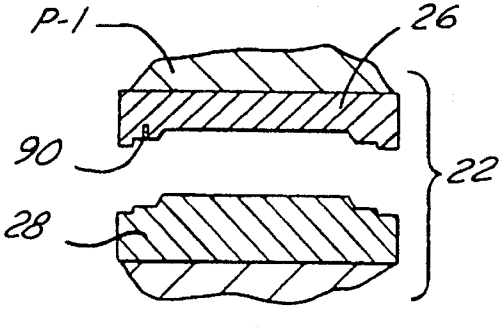

The first stamping die set 22 has upper and lower dies 26, 28 diagrammatically shown in cross section in FIG. 2A. The first die set 22, as well as the others of the stamping press line, are operated by conventional presses P-1, P-2, P-3, respectively, which move the dies between open and closed positions such as disclosed in U.S. Pat. No. 3,851,517 entitled "Process for Manufacturing curved Channel Members" issue Dec. 3, 1974 to J .P Greenleaf which is hereby incorporated by reference.

The upper and lower dies 26, 28 of die set 22 are configured to stamp the sheet metal blanks 14 into a first contoured form 30 of a part in a first stage stamping operation. After the initial stamping in which the blank is formed and trimmed into the first form, the dies are opened and the first form 30 is transferred from the first die set of station 24 by an unloader 32 having suction cups 34 which are operated to hold the first form 30 by vacuum while the unloader arm moves the first form 30 onto a transfer carriage 36 movable along railway 38 to a position at which loading mechanism 40 with suction cups 42 is operated to load the first form 30 into a second die set 46 at a second stamping station 50.

The second die set 46 has upper and lower dies 52, 54 operatively mounted in the press P-2 of the stamping press line 10. After the first form has been restruck by operation of die set 46 and press P-2 into a second stamped form 56, the second form is moved by an unloader 58 having suction cups 61, which is like the first station unloader 32, from the second die set 46 onto a transfer carriage 60. This carriage is movable along rails 62 to a loading station at which the suction cups 64 of loader 66 are engaged at locations on the second stamped form 56 so that they can, as the other loaders and unloaders, be evacuated of air and the part 56 can be retained on the loader by atmospheric pressure.

The loader 66 then retracts and moves the second form 56 into the open dies 68, 70 of the third die set 72 of the third stamping station 74. After being seated therein, the vacuum of the cups 64 is broken and the loader is retracted from the dies such as in any conventional loading and unloading devices. As in previous stamping operations, the dies of die set 72 are then closed by the associated press P-3 in the press line 10. This action stamps the part into its third configuration or finished part 76 shown in FIG. 1. The finished part 76 is then removed from the third die set 72 by the suction cups 79 of unloader 80 onto the conveyor 82 which moves the stamped and finished part 76 to an assembly point.

Figure 3:
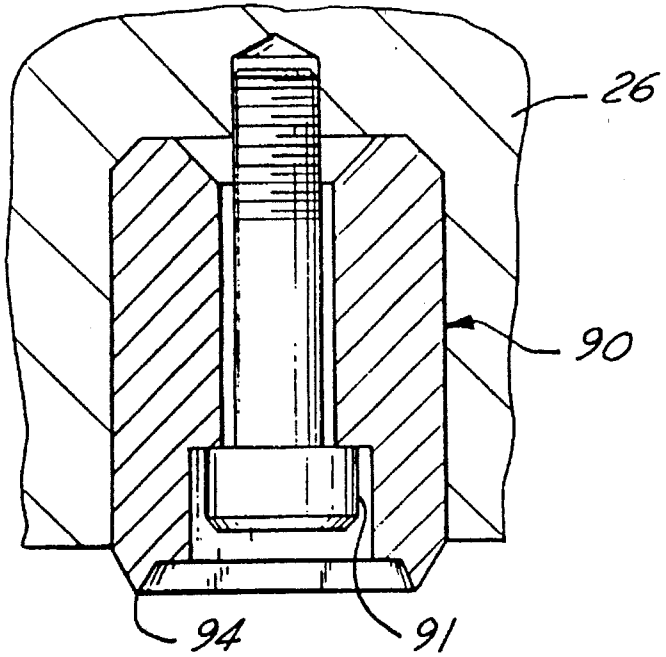
FIG. 3 is a cross-sectional view taken along section line 3—3 of FIG. 4.

A bottoming marker 90 is shown in cross-section in FIG. 3 and is installed in the upper die 26 by a threaded fastener 91. Alternately, instead of having the marker in the upper die 26, a marker 92 or 93 may be installed in one of the upper dies 52 or 68 of the die sets 46 and 72 if it is desired to make the bench mark in press P-2 or P-3 instead of press P-1. This alternate arrangement is illustratively shown in FIGS. 2B and 2C. The marker may also be mounted in one of the lower dies 28, 54, 70 if so desired. It should be understood that only one bench mark is used for each stamped part.

The bottoming markers have outboard faces with raised indentors or markers, such as shown at 94 in FIG. 3, to impress a permanent indentation or bench mark indicia in the part as the part is being stamped at one of stamping station 24 when progressing through the die line 10. The bottoming marker 90 produces the generally rectilinear geometric mark shown in FIG. 7. As best shown in FIGS. 1 and 2A, the bottoming marker 90 is located at a specific point in the upper die 26. This will produce a bench mark indica 100 on the part 76. Provision of bench marks at the edges of mating parts is preferred when the mating occurs along part edges as shown in FIGS. 8 and 9. However, the bench mark may be provided on a center portion of a part as in FIG. 7 when the parts mating occurs at an angle as shown in FIG. 7.

Figure 5:
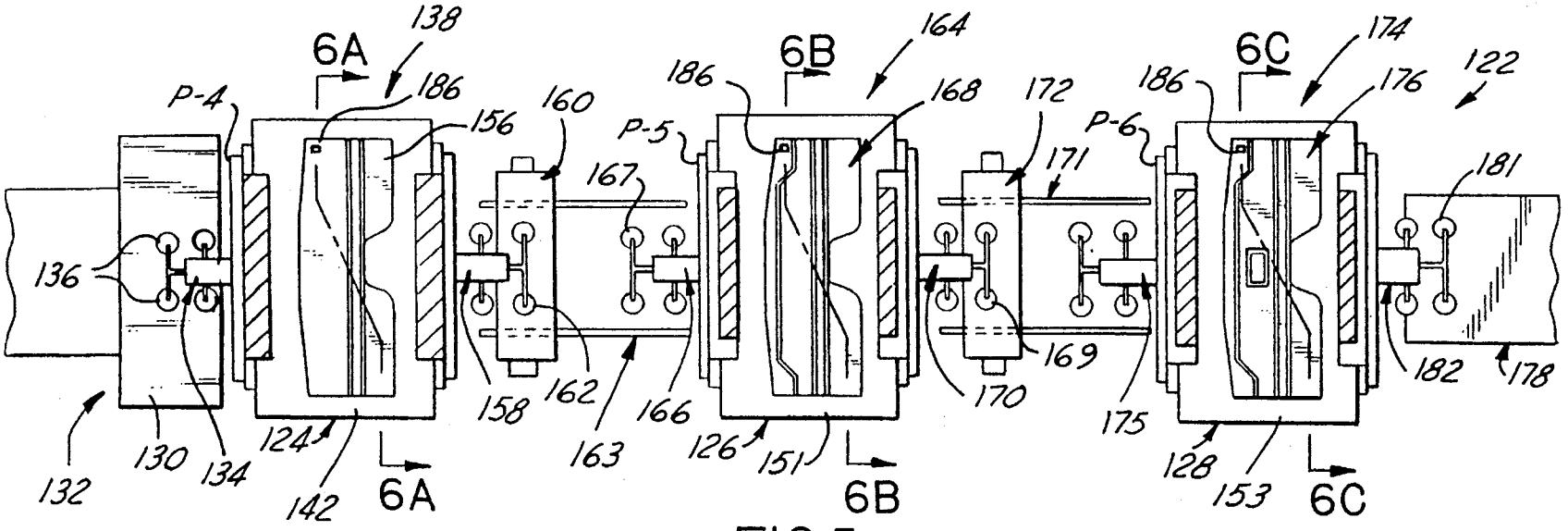
FIG. 5 is a diagrammatic top view of a second stamping line having multiple stamping stations for stamping a second part of an assembly with the upper dies removed for the purposes of clarity.
Figure 6C:
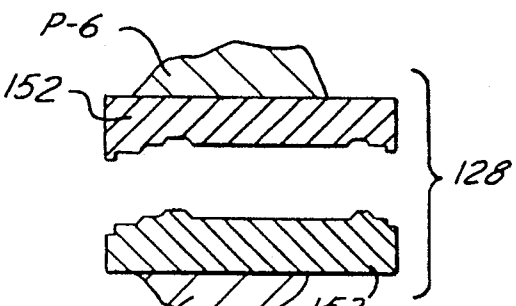
FIGS. 6A, 6B and 6C, respectively, are cross-sectional views of the stamping dies to be used in stations of FIG. 5 taken along section lines 6A—6A, 6B—6B and 6C—6C of FIG. 5.
Figure 6B:
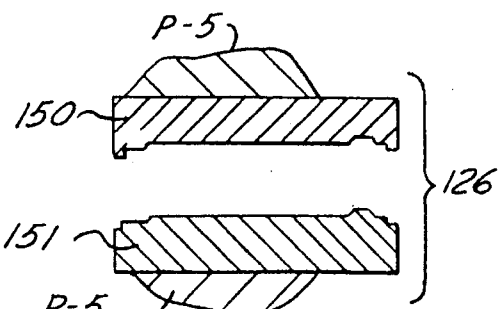
Figure 6A:
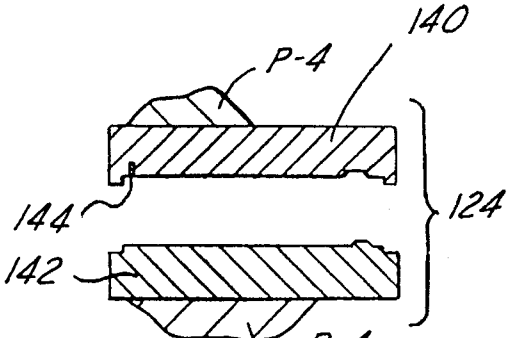

In accordance with this invention, a second finished part 176 to be joined to the first part 76 is stamped in a second multi-station stamping press line 122. As shown in FIG. 5, the second press line 122 is, with the exception of the stamping die sets 124, 126 and 128, substantially the same as the first line 10. More particularly, sheet metal blanks 130 are serially unloaded from a supply station 132 by the retractable loader 134 using suction cups 136 and transferred into the die set 124 of the first stamping station 138 of press line 122. As in the die sets of the first press line, the die set 124 has upper and lower dies 140, 142 mounted in press P-4. Also, as in the first press line, the die set 124 has a bottoming marker 144 strategically placed in the upper die 140.

After being transferred into the die set of the first station 138, the blank 130 is stamped into a first form by closure of the dies 140, 142 under press load. After such stamping, the part is unloaded by the mechanism 158 onto the transfer carriage 160 where it is released from the action of the suction cups 162. The carriage 160, operatively mounted on rails 163, transfers the first form 156 to a loading position adjacent to the second stamping station 164. At this point, the loader mechanism 166 picks up the first form 156 by action of the associated suction cups 167 to move it into the die set 126 of the second station 164, where it is restruck by the upper and lower dies 150, 151 of the second die set 126 under load of the press P-5 into a second form 168. In a continuing sequential manner, the second form 168 is unloaded from the die set 126 of the second station 164 by the suction cups 169 of unloader 170 which is like the other loader and unloader mechanisms and is operated to move the second form 168 onto transfer carriage 172. The transfer carriage, like the other carriages described, moves the stamped part to a part unloading position along rails 171 of the press line 122 adjacent to a third stamping station 174. A loader 175 picks up the second form 168 and moves it into the third die set 128 where it is restruck by the upper and lower dies 152, 153 into the second finished part 176.

The second finished part 176 is then subsequently moved from the die set 128 onto the conveyor line 178 by the suction cups 181 of the unloader mechanism 182. The conveyor 178 then moves the second finished part 176 into the assembly point where it is to be joined to the first finished part 76.

Figure 4:
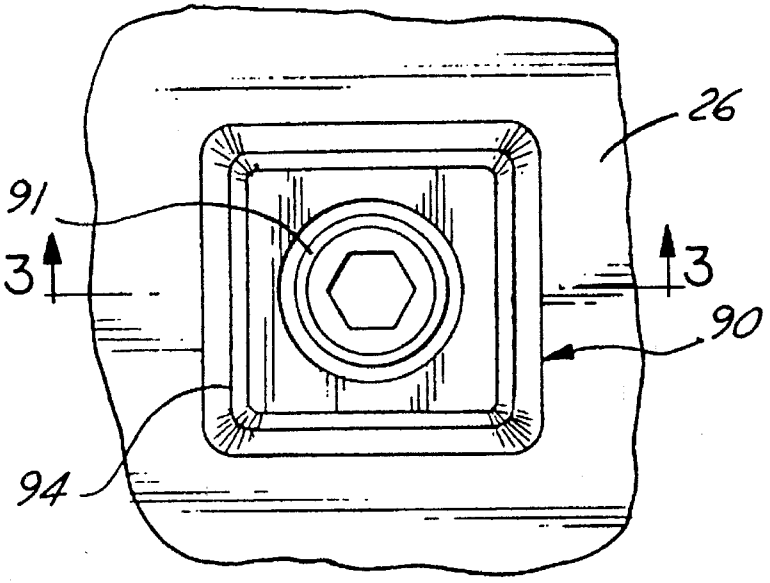
FIG. 4 is a bottom end view of a bottoming marker used in accordance with this invention.

The bottoming marker 144 which is strategically located in the die 140 of the die set 124 of the second line 122 is used to place bench mark indicia onto the second part 176 as it is being stamped along the line in a manner similar to that described in connection with the first line 10. The bottoming marker 144 is substantially the same in construction as the bottoming marker 90 of the die set 26 of the first press line 10 illustrated by FIGS. 3, 4 to produce bench mark indicia 186, which is similar to the bench mark indicia 100, on the second part 176 as it is being stamped and formed in the second press line.

Turning now to FIG. 7, the parts 76 and 176 are moved into position at substantially right angles with respect to one another at an assembly point. The assembler 200 can then readily by sight or by using a gaging tool 202 ascertain that the bench mark indicia of the two parts 76, 176 align with one another when they are clamped or held in a fixture 204, or otherwise held, and are permanently secured together such as by spot welds 206. Accordingly, part 76 can be assembled with part 176 with assurance that the two parts are accurately located with respect to each other.

FIGS. 8 and 9 illustrate a situation where two sheet metal parts 210, 212 are assembled in a relationship where the edges of the parts are in abutting relationship. A bench mark 214 in the form of a half rectangle is stamped adjacent the edge 219 of the part 210 and a bench mark 216 also in the form of a half rectangle is stamped adjacent the edge 221 of part 212. When the part 210 is positioned properly with respect to the part 212 with the edges 219, 221 as shown in FIG. 8, the bench marks 214, 216 are in alignment as shown. The relationship of the bench marks 214, 216 can be sensed by automatic scanners or directly viewed to accurately tell whether or not the sheet metal stampings are properly assembly relative to each other. The proper relative location is shown in FIG. 8.

In FIG. 9, it will be seen that the two bench marks 214, 216 of stamped parts 210 and 212 are pressed together at their abutment edges 219, 221 and bench marks 214, 216 are not in alignment with one another. The assembler or automatic scanner recognizing the visual quality indicators provided by the bench mark mismatch knows that the parts are improperly aligned with respect to each other.

Specific examples of providing bench marks on stamped sheet metal parts have been illustrated. FIG. 7 illustrates a situation wherein the mating sheet metal parts are positioned with respect to each other at approximately right angles with respect to the plane of the parts. Therefore, the bench mark 100 is provided on a central portion of the part 76 while the bench mark 186 of the part 176 is provided adjacent the edge 177. Contrariwise, bench marks 214, 216 of the parts 210, 212 as shown in FIGS. 8 and 9 are provided adjacent the edges 219, 221 so that when the parts are abutted against each other, the alignment or misalignment of the bench marks will be apparent. Preferably, the bench marks are provided in a manner such as shown in FIGS. 8 and 9 so that they will tend to abut directly against each other when the parts are assembled, therefore making the condition of proper location of the parts readily apparent. However, as shown in FIG. 7, it is not necessary that the parts be located exactly at the abutment juncture, particularly when a tool such as the gaging tool 202 is used. Many different arrangements of the bench marks on mating parts are possible and generally will be dictated by the nature of the shape of the parts as well as the condition of the mating assembly. It is also noted that in FIGS. 1 and 5, separate press lines are illustrated for manufacturing two different parts. It is not necessarily true that in each case separate lines are necessary. The same press line may be used to provide different mating parts by changing die sets. It should be further noted that the parts are not necessarily differently configured with respect to each other, in some cases, it being possible to use identical mating parts in the same assembly.

While the bench marking indicia has been illustratively shown as being rectangular in shape, other geometric figures may be used as desired, for example, circles, triangles and the like. It will be appreciated that after the mating parts are assembled, it may in some cases be desirable to adjust the parts with respect to each other until the predetermined optimal relationship of the bench mark indicia is established. In other cases, the assembly process may be of such a nature, for example, automatic, that it is not practically feasible to make an adjustment for each assembly operation. In such a case, minor variations may be permitted or the assembly apparatus may be modified to achieve a more optimal assembly.

What is claimed is:

1. A method of optimizing the assembly of at least two separately stamped mating sheet metal parts in abutting relationship, comprising the steps of:

a. in a first stamping operation, placing a first sheet metal blank in a stamping press between a first die set comprising an upper stamping die and a lower stamping die in preparation for forming a first mating part, b. providing a bottoming marker on one of the upper and lower dies for making a bench mark indicia on the first sheet metal blank at a predetermined location near to the juncture of abutment of the mating parts upon actuation of the stamping press to close the first die set on the sheet metal blank to form the desired first mating part, c. in a second stamping operation, placing a second sheet metal blank in a stamping press between a second die set comprising an upper stamping die and a lower stamping die in preparation for forming a second mating part, d. providing a bottoming marker on one of the upper and lower dies of the second set for making a bench mark indicia on the second sheet metal blank at a predetermined location near to the juncture of abutment of the mating parts upon actuation of the stamping press to close the second die set on the sheet metal blank to form the desired second mating part, e. assembling the first and second mating parts in abutting relationship, f. comparing the relationship of the bench mark indicia of the first mating part to the bench mark indicia of the second mating part with a predetermined optimal relationship, and g. adjusting the position of the first and second mating parts with respect to each other until the predetermined optimal relationship of the bench mark indicia is established.

2. The method defined in claim 1, wherein the juncture of abutment of the first and second mating parts is provided along an edge of at least one mating part, and the bench mark indicia of each mating part is provided adjacent the abutting edge of the mating part with the predetermined optimal relationship being exact alignment of the bench mark indicia.

3. The method defined in claim 2, wherein the comparison of the relationship of the bench mark indicia of the first and second mating parts with a predetermined optimal relationship is accomplished visually.

4. The method defined in claim 3, wherein the bench mark indicia is provided in the shape of a geometric figure.

* * * * *